United States Patent [19]

Asserback

[11] 4,119,695

[45] Oct. 10, 1978

[54] METHOD AND APPARATUS FOR FORMING HOLLOW CONCRETE ELEMENTS

[76] Inventor: Rolf Arne Conrad Asserback, Kungsportsavenyn 23, S-411 36 Goteborg, Sweden

[21] Appl. No.: 800,572

[22] Filed: May 25, 1977

[30] Foreign Application Priority Data

May 25, 1976 [SE] Sweden ..... 7606017

[51] Int. Cl.[2] ..... B28B 7/32

[52] U.S. Cl. ..... 264/314; 249/65; 249/91; 249/153; 249/179; 425/219

[58] Field of Search ..... 264/314, 333; 249/65, 249/153, 179, 91; 425/219

[56] References Cited

U.S. PATENT DOCUMENTS

| | | | |
|---|---|---|---|
| 857,584 | 6/1907 | Boyle | 264/314 |
| 2,299,111 | 10/1942 | Rogers et al. | 264/314 |
| 2,977,658 | 4/1961 | Smith et al. | 249/65 |

FOREIGN PATENT DOCUMENTS

| | | | |
|---|---|---|---|
| 126,257 | 8/1931 | Fed. Rep. of Germany | 249/65 |

*Primary Examiner*—Francis S. Husar
*Assistant Examiner*—John McQuade
*Attorney, Agent, or Firm*—Harness, Dickey & Pierce

[57] ABSTRACT

A method and a device to cast elongate concrete structural members formed internally with channel means in horizontal moulds. The channel means is formed by a double-wall inflatable hose of an elastic and flexible material which is introduced into the mould and is provided with support walls extending between the inner and outer hose walls so as to divide the space therebetween into longitudinal chambers. After inflation of these chambers, concrete is poured about the hose while at the same time weights displaceable in the interior of and in the longitudinal direction of said hose, exert a load on the hose, thus preventing it from being lifted from its predetermined position inside the mould by the concrete.

8 Claims, 7 Drawing Figures

METHOD AND APPARATUS FOR FORMING HOLLOW CONCRETE ELEMENTS

BACKGROUND OF THE INVENTION

When casting concrete beams formed internally with at least one longitudinal channel in upright moulds it is known to use longitudinal, inflatable hoses of rubber, soft plastics or some similar elastic and flexible material, which hoses are placed in the mould and clamped in position during the casting process to prevent them from being lifted from their predetermined position inside the mould by the concrete introduced into the mould. After the casting, the hoses are deflated and then pulled out of the cast object. When concrete piles or similar concrete structural members, such as concrete flooring slabs, of the type having internal longitudinal channels, are manufactured in horizontal moulds, tubes are used as the hollow means, which tubes are inserted into and retained in the mould whereafter the concrete is poured into the mould so as to surround the tubes. As the tubes are left inside the cast objects, the costs thereof are considerably increased without attributing to any significant degree to the durability and strength of the product. To use an inflatable hose as the hollow means has proved impossible in these cases, because the concrete, when poured about the hose, lifts the hose from its intended position.

SUMMARY OF THE INVENTION

The subject invention concerns a method of manufacturing concrete piles or concrete structural members formed internally with longitudinal channels in horizontal moulds without using tubes to form the channels. It is characteristic of the invention that as the hollow means is used a double-wall hose known per se of rubber, plastics or some similar elastic and flexible material and open at least at one end, said hose provided with support walls extending between the hose walls, whereby the space between the hose walls is divided into longitudinal chambers, that the latter are inflated, and that during the pouring of concrete about the hollow means, a weight, displaceable in the interior of and in the longitudinal direction of the hollow means, exerts a load on said hollow means to prevent the latter from being lifted out of its predetermined position inside the mould by the concrete.

When the concrete has set, the air is evacuated from the hose and the latter may be extracted from the cast object and used in the casting of subsequent objects.

The invention likewise concerns a device for carrying out the method of manufacturing concrete piles or concrete structural members provided with one or several longitudinal channels by casting in horizontal mould into which may be introduced one or several hollow means extending in the longitudinal direction of the mould and supported by spacer members, these hollow means intended to be surrounded by concrete inside the mould and formed by double-wall, inflatable hoses of rubber, plastics or some similar elastic and flexible material. The device in accordance with the invention is characterised in that support walls are provided extending between the hose walls in such a manner that the space intermediate said hose walls is divided into longitudinal chambers arranged to be inflated, and in that a weight is arranged for displacement in the interior of the hollow means in the longitudinal direction thereof to exert a load on said hollow means.

BRIEF DESCRIPTION OF THE DRAWINGS

The invention will be described in more detail in the following with reference to the accompanying drawings, wherein.

DETAILED DESCRIPTION OF A PREFERRED EMBODIMENT

Figure 1:
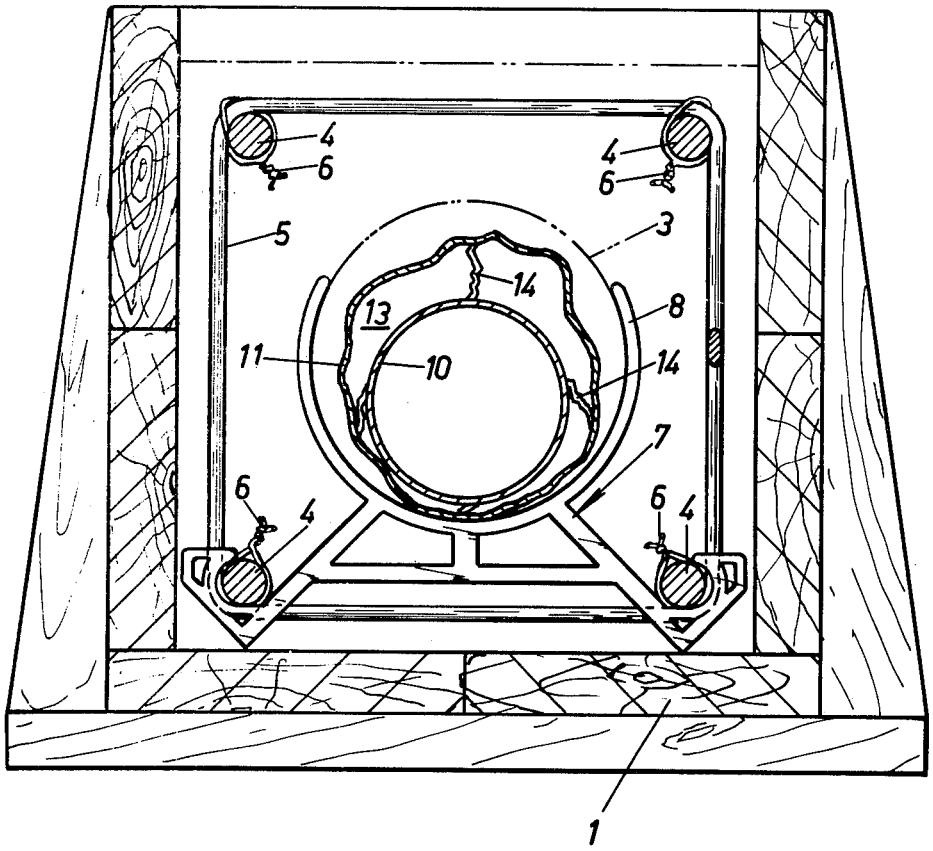
FIG. 1 is a vertical cross-sectional view through a mould designed for the manufacture of a concrete pile formed internally with a longitudinal channel.
Figure 2:
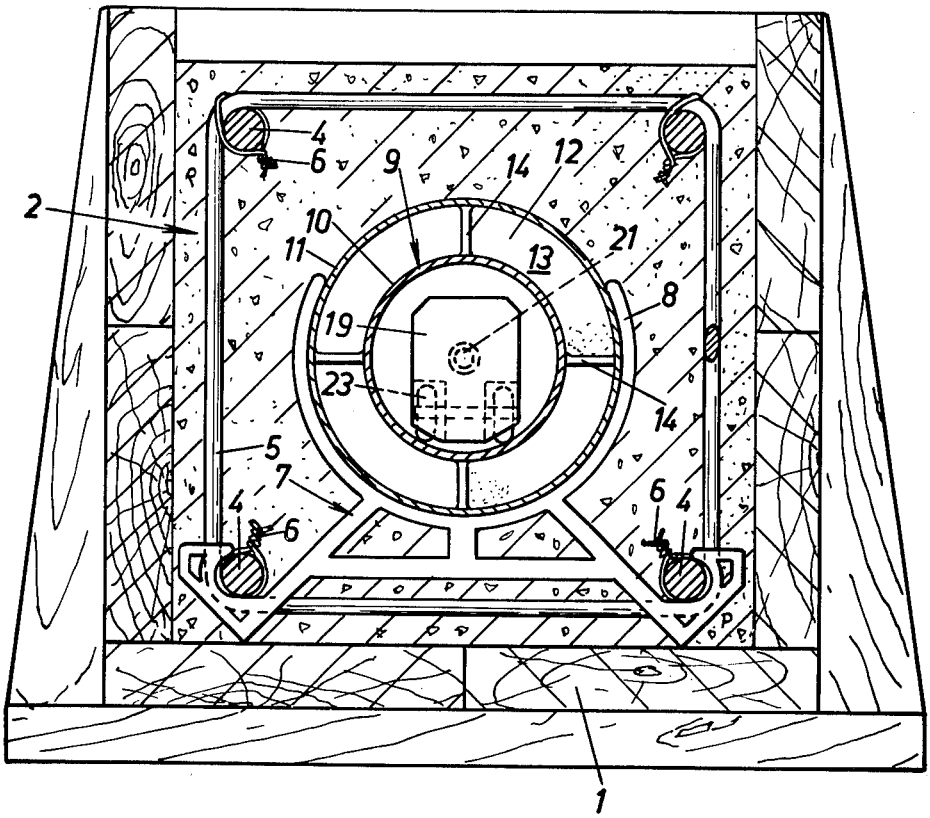
FIG. 2 is a similar sectional view illustrating the pile in finished condition.

FIGS. 1 and 2 illustrate a mould 1 designed for the manufacture of a reinforced concrete pile 2 formed internally with a central longitudinal channel 3. The longitudinal reinforcement rods 4 of the concrete pile are enclosed by an iron bar 5 serving as a cross-wise reinforcement means and secured to the rods 4 by lashing wires 6. In this manner is formed an elongate reinforcement cage which is introduced into the mould and supported therein by equidistantly spaced spacer members 7, which preferably are made from rigid plastics. A preferred distance between the spacer members is between 1 and 1.5 meters when casting concrete piles having a length of approximately 10 to 18 meters.

The spaceer members 7 form at their top semi-circular arms 8 supporting a double-wall hose 9 of rubber, plastics or some similar elastic and flexible material. The inner wall 10 of the hose 9 is considerably more rigid than the outer wall 11 thereof. The annular chamber 12 formed between the hose walls 10 and 11 has end walls 13 and also elongate support walls 14. The chamber 12 may be inflated, whereby the hollow means formed by the hose 9 and resting on the spacer members 7, takes on the shape illustrated in FIG. 2. Owing to the rigidity of the inner wall 10 the latter retains its shape substantially unaltered when the hose 9 is inflated.

Figures 5, 6, 7:
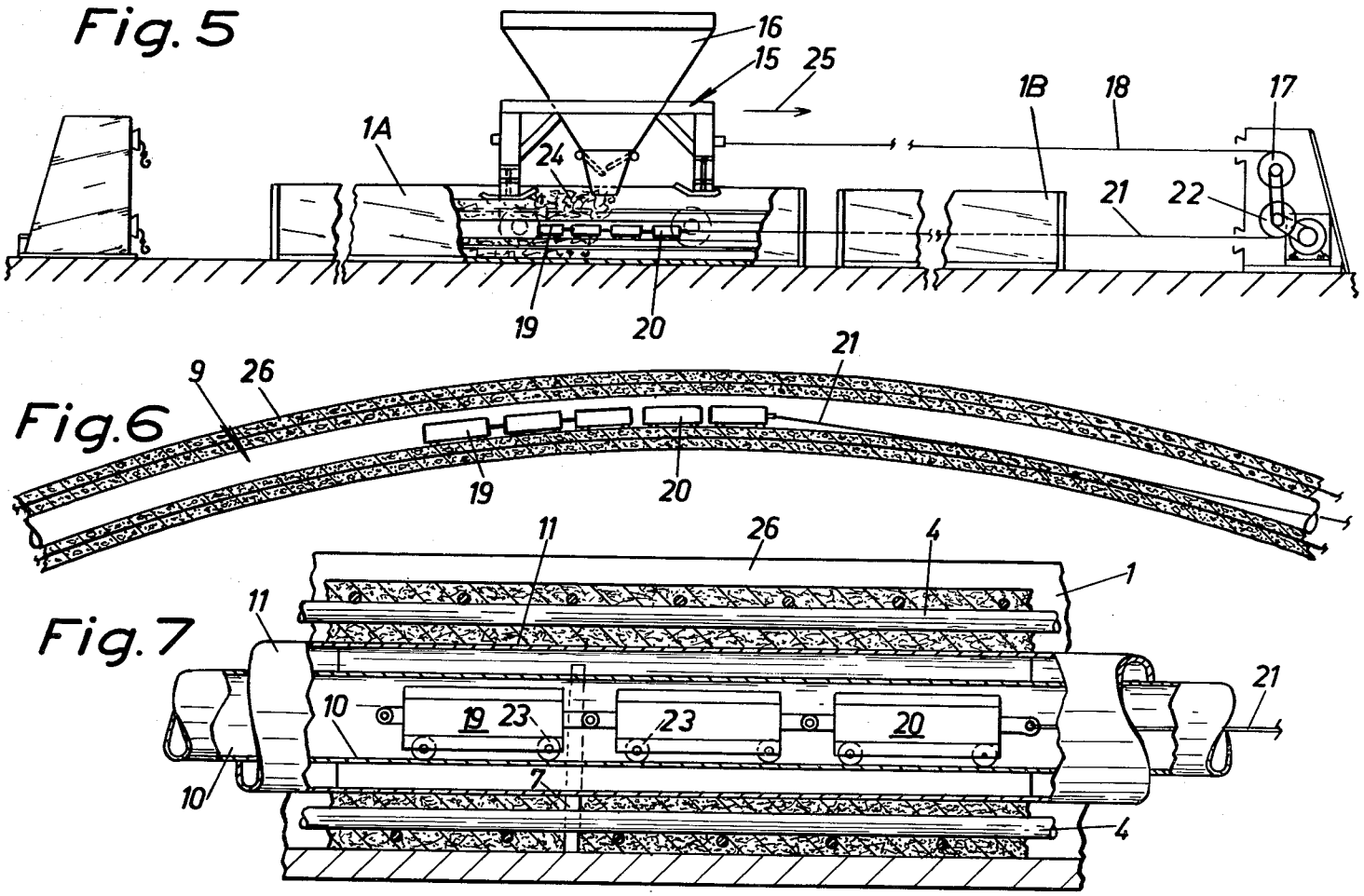
FIG. 5 is a diagrammatical, partly broken side view of an apparatus for performing the method in accordance with the invention.
FIG. 6 is a broken lateral view of a section of a concrete arch or a concrete bridge.
FIG. 7 illustrates on an enlarged scale a section of the concrete object shown in FIG. 6 while being cast.

FIG. 5 illustrates an apparatus designed for casting concrete piles of the kind shown in FIG. 2. Two moulds 1A and 1B are imagined positioned in end-to-end relationship in their longitudinal direction. Above the moulds 1A, 1B is arranged a carriage 15 which is displaceable in the longitudinal direction of the moulds and provided with a funnel-shaped container 16 holding concrete. A winch 17 and a pulling wire 18 displace the carriage 15 along the moulds. The apparatus likewise comprises a number of weights 19, 20, coupled together in a successive row, and by means of a pulling wire 21 and a winch 22 they may be displaced inside the hose 9 in the longitudinal direction thereof while running on the inner hose wall 10 on rollers 23. The weights 19, 20 exert such a load on the hose 9 that the latter is prevented from being lifted by the concrete 24 inside the mould 1A from its pre-determined, central position. As the concrete mixture 24 is poured into the mould 1A opposite the weights 19, 20 and the carriage 15 is displaced along the mould, see the arrow 25 in FIG. 5, the weights 19, 20 are likewise displaced in the same direction and at the same speed.

When the casting of the object in the mould 1A is finished, a reinforcement cage consisting of reinforcement rods 4 and reinforcement iron bars 5 is introduced into the mould 1B so as to be supported by a number of spacer members 7. A hose 9 is introduced endwise into the mould so as to rest on the support arms 8. The hose is inflated by introduction of pressurized air into the chamber 12. The carriage 15 is pulled by means of the wire 18 and also the weights 19, 20 are pulled by means of the wire 21 across to the mould 1B which is filled in the manner described above with the concrete mixture.

When the concrete in the mould 1A has set, the hose inside the cast object is evacuated and extracted. After extraction of the object from the mould 1A, a reinforcement cage is again placed therein in the manner described above and provided with a hose 9 which is inflated. The carriage 15 and the weights 19, 20 are thereafter pulled respectively above and through the mould 1A, this time in the opposite direction, i.e., to the left as seen in FIG. 5. The mould 1A is again gradually filled with the concrete mixture.

Owing to the design of the hose 9 allowing it to be bent arcuately, it is possible to manufacture concrete arches 26 (FIG. 6) having central channels therein extending along the arc. FIG. 7 illustrates on an enlarged scale a section of this arch 26 while being cast opposite the point occupied by the weights 19, 20.

Figure 3:
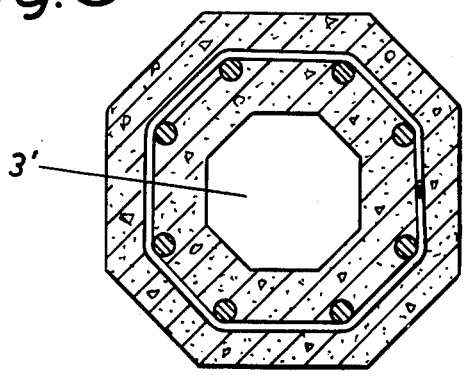
FIG. 3 is a cross-sectional view through an octagonal pile.
Figure 4:
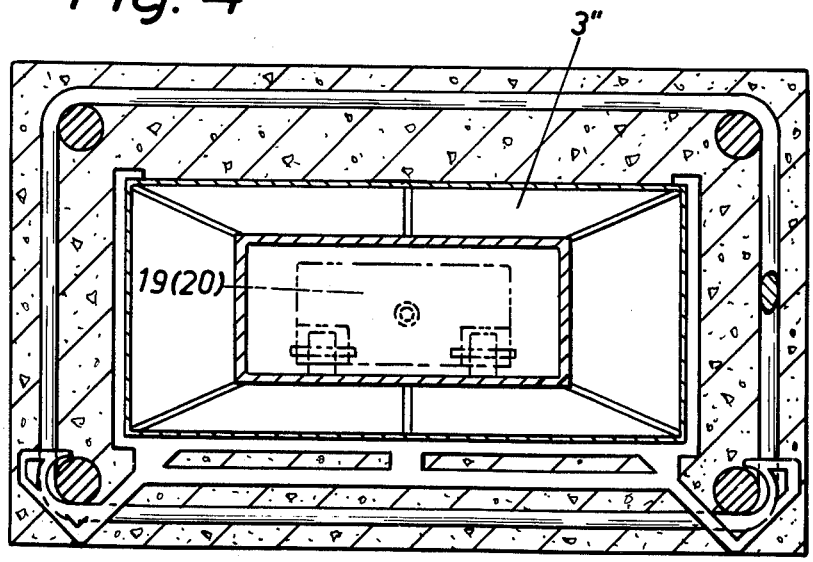
FIG. 4 is a cross-sectional view through a rectangular concrete structural flooring member or pile.

In the manufacture of concrete objects in accordance with the subject invention, one is by no means dependent on the desired shape, as appears from FIGS. 3 and 4. FIG. 3 illustrates a concrete pile having a cross-sectional shape of a regular octagon formed with a correspondingly shaped longitudinal channel 3'.

FIG. 4 illustrates a cross-section through a horizontal beam or a concrete structural flooring member having a rectangular cross-sectional configuration and formed with a central channel 3''.

The embodiments as described and illustrated are to be regarded as examples only and the method as well as the apparatus for carrying it out may be altered in a variety of ways within the scope of the appended claims. For instance, the shape of the cast concrete object as well as that of the channel or channels therein are independent of the invention. The bond (walls 14) between the two walls 10 and 11 of the hose 9 may be arranged and designed in a different way from that described and illustrated in the drawings. The weights 19, 20 may be supported on the inner face of the inner hose wall 10 in another manner than by rollers 23. Sliding members could for instance be used for the same purpose and to the same advantage.

I claim:

1. An improved method of manufacturing in horizontal moulds elongate concrete structural members formed internally with at least one longitudinal channel, comprising the steps of introducing into the mould in a horizontally extending direction a double-wall hose of an elastic and flexible material to form said channel the inner wall of said hose being open at least at one end and provided with support walls extending between said hose walls to divide the space between said hose walls into longitudinal chambers, inflating said chambers, casting concrete about said hose, exerting a downward load on said hose by means of weights in the interior of said hose to prevent displacement thereof, and displacing said weights in the longitudinal direction of said hose.

2. In a device for manufacturing elongate concrete structural members formed internally with at least one longitudinal channel by casting in horizontal moulds, comprising a horizontally extending mould, at least one hollow means introduced into said mould and extending in the longitudinal direction of said mould, said hollow means formed by double-wall, inflatable hose of an elastic and flexible material and adapted to be surrounded by concrete inside said mould, the improvement comprising support walls extending between said hose walls so as to divide the space intermediate said hose walls into a plurality of inflateable longitudinal chambers, and a weight adapted to be displaced in the interior of and in the longitudinal direction of the inner wall of said hollow means to exert a load on said hollow means and prevent lifting thereof during casting.

3. An improved device according to claim 2, wherein the inner wall of said hose is considerably more rigid than the outer wall thereof.

4. An improved device according to claim 2, wherein the weight comprises a number of heavy bodies interconnected in a row rollers on said weights, and a flexible pulling means to effect displacement of said weights in the interior of and in the longitudinal direction of said hose.

5. An improved device according to claim 4, further including sliding members on the weights to facilitate displacement thereof inside said hose.

6. An improved device according to claim 3, wherein the weight comprises a number of heavy bodies interconnected in a row, rollers on said weights, and a flexible pulling means to effect displacement of said heavy bodies in the interior of and in the longitudinal direction of said hose.

7. An improved device according to claim 2, further including a number of spacer members arranged in spaced-apart positions inside the mould to support the hose in the longitudinal direction of said mould.

8. An improved device according to claim 7, further including reinforcement rods, the spacer members arranged to support said rods inside the mould.

* * * * *